United States Patent [19]

Browning

[11] 3,982,468

[45] Sept. 28, 1976

[54] PISTON AND OBTURATOR ASSEMBLY FOR AUTOLOADING FIREARMS

[75] Inventor: Val A. Browning, Ogden, Utah

[73] Assignee: Browning Arms Company, Morgan, Utah

[22] Filed: Nov. 1, 1972

[21] Appl. No.: 302,655

[52] U.S. Cl. ..... 89/193; 89/198

[51] Int. Cl.[2] ..... F41D 5/10

[58] Field of Search ..... 89/191, 192, 193, 198

[56] References Cited

UNITED STATES PATENTS 2,144,241 1/1939 Eianc ..... 89/193 X 3,127,812 4/1964 Into et al. ..... 89/193

*Primary Examiner*—Stephen C. Bentley

*Attorney, Agent, or Firm*—Trask & Britt

[57] ABSTRACT

In an autoloading firearm, reloading is actuated by firing gases which are tapped from near the muzzle end of the barrel into a tubular magazine secured below the barrel. A reciprocating piston located inside the magazine is connected to a reloading mechanism and is driven to actuate the mechanism by the tapped gases. A cylindrical obturator is oppositely driven by the gases to scrape the interior of the magazine and serves as a valve to vent the gases.

17 Claims, 5 Drawing Figures

PISTON AND OBTURATOR ASSEMBLY FOR AUTOLOADING FIREARMS

BACKGROUND OF THE INVENTION

1. Field:

This invention relates to a gas-actuated autoloading firearm, such as a semiautomatic shotgun, of the type wherein firing gases are tapped from near the muzzle end of the barrel into a tubular magazine below the barrel. More particularly, the invention relates to a novel piston and obturator assembly for use in the magazine of such a firearm.

2. State of the Art:

In a typical autoloading shotgun of the gas-actuated type, a tubular magazine for housing cartridges is mounted below and parallel to the barrel of the shotgun, and firing gases are tapped from the barrel into the magazine. The gases actuate reloading mechanism associated with the magazine tube. Usually the end of this magazine which is near the muzzle of the barrel is supported by a barrel ring, and the firing gases are tapped through a channel which is formed in the barrel ring into an annular cylinder surrounding the magazine. The tapped gases then press against the face of an annular piston which is slidably disposed in the annular cylinder. The piston is thus driven towards the breech of the shotgun. The motion of the annular piston is coupled to further mechanism to expel the spent cartridge from the breech while loading another shell thereinto in position for firing. One problem with such arrangements is that the firing gases often carry solid particles such as powder into the cylinder. Such particles may build upon the wall of the cylinder causing the piston to drag or stick. This buildup also tends to make it difficult to remove the piston and associated parts from the front of the magazine tube.

SUMMARY OF THE INVENTION

The present invention pertains to a gas-actuated, unloading firearm of the type wherein firing gases are tapped from near the muzzle end of the barrel into a tubular magazine secured in fixed position below the barrel. The present invention provides a novel, mutually reciprocating piston and obturator assembly operable within the magazine of such firearm. The piston is adapted to be driven to actuate reloading and the obturator is adapted to clean contaminates from the magazine as well as to act as a valve to vent firing gases from the magazine as it, the obturator, moves away from the piston. An actuating pin extends transversely through the piston sleeve and is therein fitted with resilient means which absorb shocks as the pin and piston are driven by the firing gases. Among other advantages of the inventive assembly, firing gases are prevented from leaking past the piston.

BRIEF DESCRIPTION OF THE DRAWING

The present invention may be more readily understood by referring to the following description and appended drawings which are offered by way of illustration and not in limitation of the invention, the scope of which is defined by the appended claims and equivalents. In the drawings:

DESCRIPTION OF THE ILLUSTRATED EMBODIMENT

Figure 1:
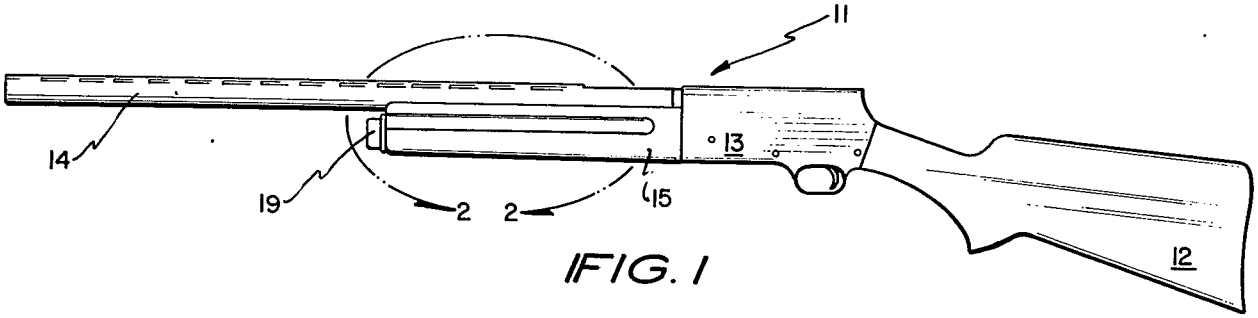
FIG. 1 is an elevation of a firearm of the type employing the inventive mechanism.
Figure 3:
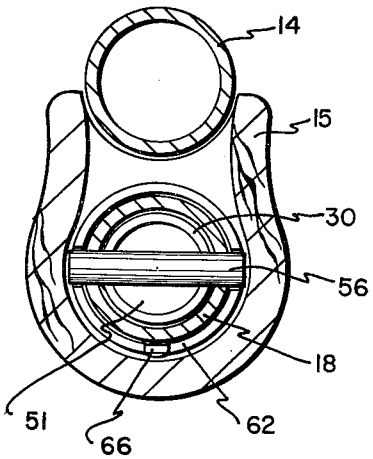
FIG. 3 is a cross sectional view taken in the plane of the line 3—3 in FIG. 2 viewed in the direction of the arrows.

An autoloading shotgun, generally designated 11 in FIG. 1 has a stock or shoulder piece 12 which is fixed to a receiver 13. The receiver, comprising the action or breech of the firearm, has a barrel 14 releasably fastened thereinto. Below and parallel to the barrel is mounted a tubular magazine (not visible, see FIG. 2, 18) enclosed by a typical wooden forearm 15.

Towards the forward or muzzle end of the barrel 14, a conventional barrel ring 16 (see FIG. 2) fixedly depends from the barrel to support the tubular magazine 18. The forward end of the magazine 18 is slidably received through the ring 16 and the other end is secured to the breech (receiver 13) of the shotgun. A cap 19 is threaded over the forward end of the magazine and bears against the barrel ring to secure the entire assembly — comprising the receiver, the barrel and the magazine — together.

At least one channel 23 is formed through the barrel ring 16 to interconnect an aperture 24 in the wall of the barrel 14 to an aperture 26 through the wall of the magazine 18. Gases released upon firing a cartridge are tapped via channel 23 into the forward end of the magazine wherein they act upon an assembly according to the invention.

The inventive assembly as shown in FIGS. 2 through 5, comprises, inter alia, a piston 29 (including a hollow sleeve portion 30) and an obturator 31. Both the piston and the obturator are cylindrical and are freely slidable in the magazine. Both include integral circumferential rings 38 and 39, respectively. At least the front and rear circumferential edges of the rings are sharp so that the interior of the magazine is scraped by the rings when the piston and obturator slide therein.

Figure 2:
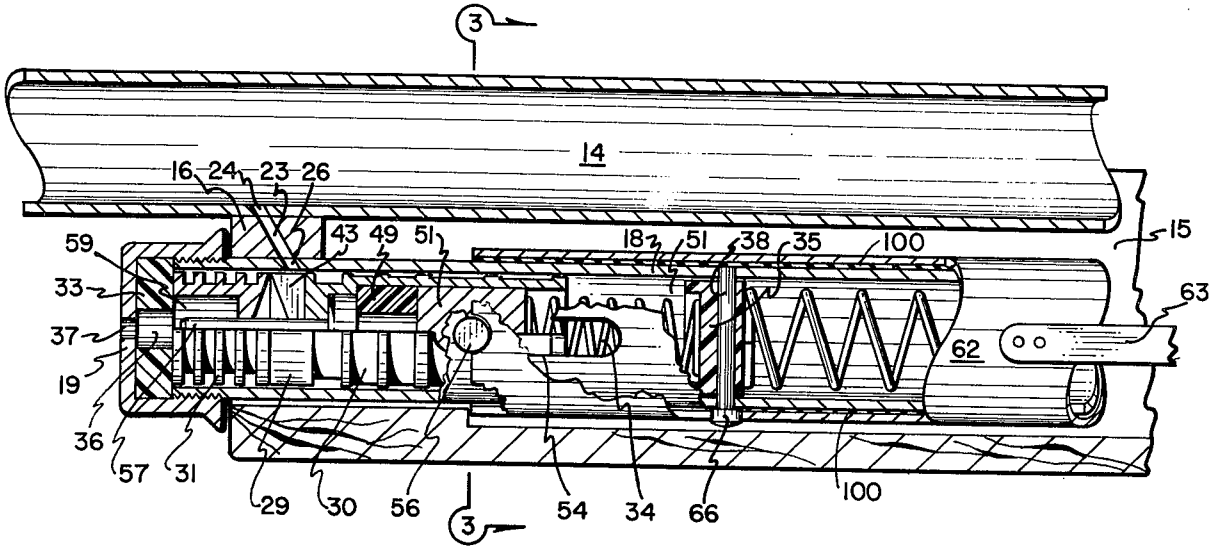
FIG. 2 is a partially cutaway detail view of the portion of the firearm encircled by the arrows 2-2 in FIG. 1 and shows one position of the inventive mechanism.
Figure 4:
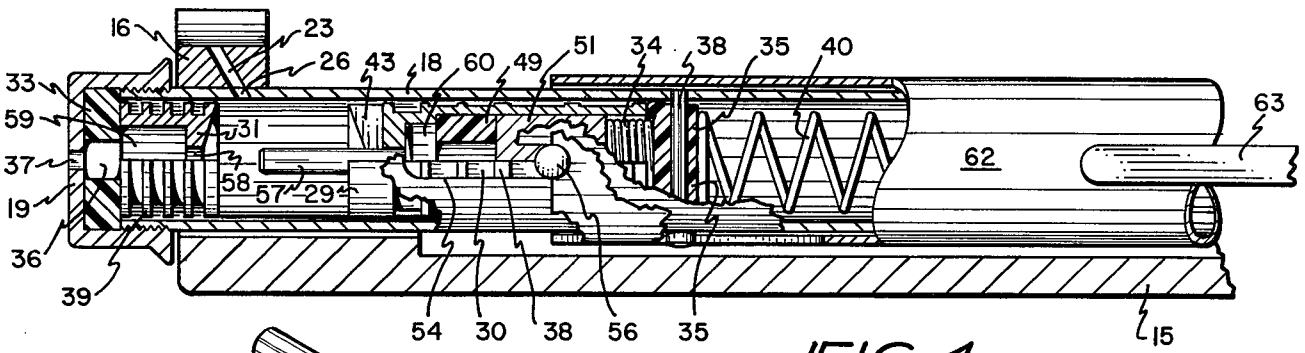
FIG. 4 is a detail view generally the same as FIG. 2 but showing the mechanism in another position.
Figure 5:
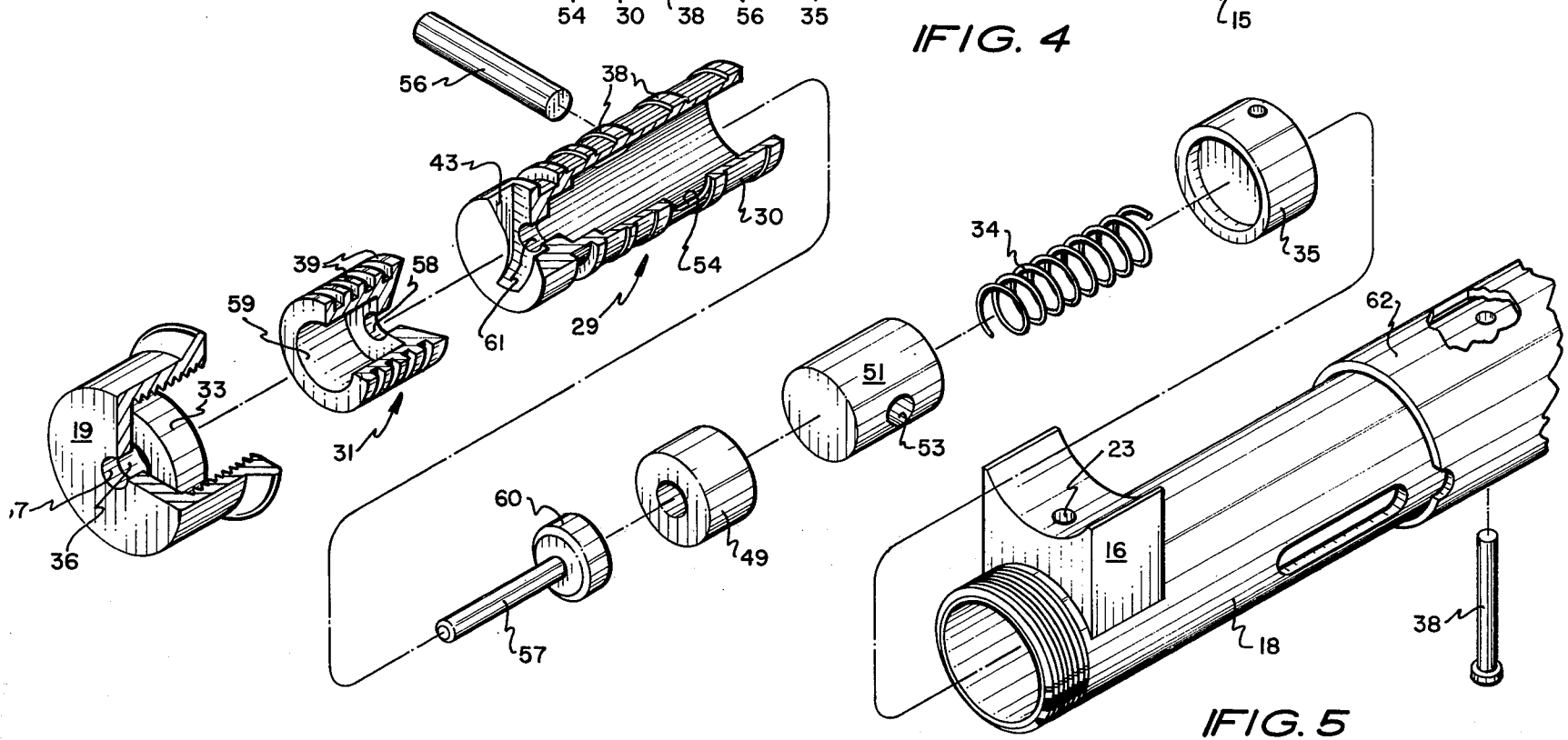
FIG. 5 is an exploded pictorial view of a portion of the mechanism shown in FIG. 2.

The obturator 31 is placed in the magazine between the piston 29 and the cap 19 and, prior to firing, the piston and obturator are maintained in the magazine in the position shown in FIG. 2. That position is due to further elements of the assembly, namely, the opposed springs 33 and 34. Spring 33 is illustrated as a resilient disc fabricated of, for example, polyurethane. One end of the disc 33 presses against the obturator, and the other end presses against the inside of cap 19. A channel 36 is formed coaxially through the disc 33 and registers with a gas relief port 37 formed through the cap 19. One end of a second springs 34 (shown as a helical spring) is received within the hollow sleeve portion 30 of the piston 29; the other end of that spring 34 bears against a disc-like partition or abutment 35 fixed in position in the magazine by a pin 38 which is secured transversely of the magazine. The abutment 35 may be formed of resilient material such as polyurethane. A conventional spiral magazine spring 40 is contained within the magazine tube 18 opposite the partition 35 from the spring 34. The other end of the spiral magazine spring 40 bears against a spring follower (not shown) in conventional fashion to urge cartridges stored within the magazine toward the receiver 13 of the firearm.

The face of the piston 29 has a slot 43 milled or otherwise formed therein. The slot runs generally diametrically across the piston face. One end of the slot terminates short of the piston sleeve 30, but the opposite end opens through the sleeve. When the piston and obturator are in the contiguous position shown in FIG. 2, the open end of the slot 43 is in position to admit firing gases between the piston and obturator so that the gases drive the two apart. As shown, the face of the piston and the adjacent face of the obturator are both concave to reduce the area of contact therebetween when they are in the contiguous position.

A rod 57 is fitted to the face of the piston 29 and extends axially outward therefrom. An aperture 58 is formed coaxially through the face of the obturator so that the rod telescopes through the aperture into a bore 59 on the other side of the obturator as in FIG. 2. The length of the rod is such that when the piston and obturator are in the parted position shown in FIG. 4 (i.e., substantially at the end of the power stroke), the distal end of the pin is fully withdrawn from the aperture 58. Thus, a pathway is formed for venting of the firing gases from the magazine. Specifically, the gases pass from between the piston and obturator through aperture 43 into the channel 36 in the resilient disc 33, and then out the cap 19 through port 37. Consequently, a valve is formed by the rod 57 and the obturator such that firing gases are vented from the magazine after the piston and the obturator are driven apart. The rod 57 may be fastened to the piston in various ways. As illustrated, a disc 60, integral with the end of the rod 57, is retained inside the piston while the rod projects through an appropriately formed aperture 61 in the piston face.

According to the invention, a cylindrical insert 49 of resilient material, such as polyurethane, is desirably installed in the piston sleeve 30. A rigid, cylindrical member 51 formed, for example, of stainless steel, is slidably disposed within the piston sleeve 30 towards its open end. Thus, the resilient insert 49 forms a cushion between the cylindrical member 51 and the rear of the face of the disc 60. Both the resilient insert 49 and the cylindrical member 51 are slidable within the piston sleeve 30.

A channel 53 (FIGS. 2, 3 and 5) is formed, as by drilling, diametrically through cylindrical member 51. Opposed elongated slots 54 are formed in the piston sleeve 30; the width of those slots is substantially the same as the diameter of the channel 53. With the slots 54 and the channel 53 in a registered relationship, a pin 56 is conveniently placed through the channel to retain the resilient insert 49 and the cylindrical member 51 within the piston sleeve. The pin is of sufficient length that its ends extend slightly past the piston sleeve 30. Consequently, the resilient insert 49 is maintained in the piston ahead of the cylindrical member 51 by the transverse pin 56 extending through the diametrically opposed slots 36 in the sidewall of the piston.

The pin 56 also drives an ejection mechanism during the power stroke of the piston. That ejection mechanism is exterior to the magazine and comprises a sleeve 62 which surrounds the magazine and is mounted for reciprocation thereon. An elongated action connection bar 63 is fixed at one end to the sleeve 62, and its other end is keyed into conventional mechanism (now shown) in the receiver. As the sleeve reciprocates along the magazine, the bar 63 actuates the mechanism in the receiver to eject a spent cartridge from the breech while loading another cartridge thereinto. A peg 66 may be fixed to the outer wall of the magazine at about the forwardmost position of the end of the sleeve 62 so that the peg 66 stops the sleeve just as it reaches transverse pin 56 on its return stroke. Means (also well-known) are provided in the receiver normally to bias the sleeve towards the end of the magazine as shown in FIG. 1.

The exterior of the magazine desirably has a helical groove (100, FIG. 2) formed thereon with the edge of the grooves somewhat sharpened so that accumulations of particles (e.g., from the firing gases) are scraped from the inside of the sleeve as the sleeve reciprocates on the magazine.

The operation and advantages of the apparatus of the invention may now be readily understood. Upon firing a cartridge, the firing gases a high pressure spurt from the barrel through channel 23 into the magazine. When the gases first enter the magazine, the piston 29 and obturator 31 are contiguous (FIG. 2), due to the pressure of springs 33 and 34; the slot 43 which is formed in the face of the piston (or in the face of the obturator) allows the firing gases between the piston and the obturator. The pressure of the expanding gases ultimately drives the two apart. The piston moves rearward in the magazine to actuate the cartridge ejection mechanism while the obturator moves forward to compress the spring 33. When the piston and obturator are substantially displaced from one another, the rod 57 is fully withdrawn from the aperture 58 in the obturator so that the gases may vent from between the piston and obturator via the previously described pathway. Thence the spring 33 reciprocally returns the obturator to its original position. During its short reciprocating movement, the sharp rings 31 on the obturator scrape the inside wall of the magazine to remove any contaminates, such as powder deposits from the firing gases, therefrom.

The piston 29 likewise reciprocates in the magazine. It is driven toward the breech by the pressure of the firing gases and is returned to position by the spring 34. As the firing gases are not vented until the piston has moved substantially (i.e., until rod 57 is withdrawn from aperture 58), the full initial force of the rapidly expanding gases is utilized to drive the piston. Compared to an arrangement wherein firing gases are continuously vented, the described arrangement loses none of the initial force of the firing gases. By fully utilizing the initial force of the expanding gases, the piston 29 quickly acquires sufficient momentum to drive the reloading mechanism and requires a comparatively short stroke. The abutment 35 is arranged fairly close to the initial position of the piston, but by the time the piston's movement is checked thereby, it has already imparted enough momentum to the ejection mechanism (including sleeve 62 and lever 63) so that the mechanism by its own inertia continues rearward to perform the functions of automatic operation and to compress a return spring.

When the piston 24 drives the sleeve 62 via the pin 56, the forces on the pin and piston sleeve are cushioned by the resilient insert 49. Thus, failure or deformation of the pin are less likely. Similarly, when the piston stops against the abutment 35, a portion of the shock is absorbed by the resilient insert 49. When the abutment is formed of resilient material, it too absorbs some of the shock.

The short stroke of the reciprocating piston is of particular importance. With the short stroke, the piston returns immediately to the high temperature area adjacent the barrel ring. The piston absorbs sufficient heat at the high temperature region to be at substantially the same temperature, and hence diameter, as the portion of the magazine at the high temperature region. If the piston were allowed to cool relative to that portion of the magazine, its diameter would decrease, thereby permitting gases to flow in the annular space between the piston and the interior wall of the magazine. Deposits would then form, to the detriment of proper operation of the piston. With a short stroke, relative thermal expansion between the piston and magazine is minimal. The piston is desirably provided with scraping rings, as shown, to maintain the interior wall of the magazine free of deposits of contaminates.

I claim:

1. In an autoloading firearm of the type in which reloading is actuated by firing gases tapped from the barrel into a gas chamber attached to the magazine to drive a piston connected to a loading mechanism, the improvement comprising:

a cylindrical obturator slidably disposed in the gas chamber and arranged to be driven away from said piston by the tapped gases;

gas relief means opposite said obturator from said piston; and valve means cooperative between said obturator and the piston to vent the gases from the gas chamber through said gas relief means when said obturator and the piston move apart; wherein said obturator has a channel formed axially therethrough and said valve means includes a member which withdraws from said channel when said obturator is driven away from the piston to allow the firing gases to vent through said channel.

2. The improvement of claim 1, wherein a peripheral portion of said obturator is of sufficient diameter and sharp enough to scrape from the gas chamber wall, as said obturator reciprocates in the gas chamber, deposits of contaminates left by the firing gases.

3. The improvement of claim 2, wherein said peripheral portion comprises at least one circumferential ring on said obturator proper.

4. The improvement of claim 1, wherein said member is fixed to the piston.

5. The improvement of claim 1, further comprising biasing means arranged between said obturator and to the end of gas chamber to return said obturator to its original position after the firing gases are vented from the gas chamber.

6. In a gas-actuated autoloading firearm of the type wherein firing gases are tapped from the barrel into a gas chamber attached to a tubular magazine fixedly secured below the barrel, the improvement comprising:

a piston slidably disposed in the gas chamber to be driven rearward toward the breech of the firearm by the tapped gases and adapted to actuate mechanism to reload the firearm;

a cylindrical obturator slidably disposed in the gas chamber and arranged to be driven away from said piston by the tapped gases;

vent means for exhausting gases from said gas chamber opposite the obturator from the piston;

valve means cooperative between said piston and said obturator to vent the gases from the gas chamber when said piston and obturator move apart; and first and second biasing means to return both said piston and said obturator, respectively, to their original positions after the firing gases have been vented by said valve means through said vent means; wherein said obturator has a channel formed axially therethrough and said valve means includes a member which withdraws from said channel when said obturator is driven from the piston to allow the firing gases to vent through said channel.

7. The improvement of claim 6, wherein a peripheral portion of said obturator is of sufficient diameter and sharp enough to scrape from the gas chamber wall, as said obturator slides in the gas chamber, deposits of contaminates left by the firing gases.

8. The improvement of claim 7, wherein a peripheral portion of said piston sleeve has at least one circumferential ring formed therearound and said ring is of sufficient diameter and sharp enough to scrape from the magazine wall, as said piston slides in the magazine, deposits of contaminates left by the firing gases.

9. The improvement of claim 7, wherein said peripheral portion comprises at least one circumferential ring on said obturator proper.

10. The improvement of claim 6, wherein said member is fixed to said piston.

11. The improvement according to claim 10, wherein said first biasing means includes a resilient member arranged between said obturator and the near end of the gas chamber.

12. The improvement according to claim 11, wherein an aperture is formed through said resilient member to permit the firing gases to pass therethrough from said channel in said obturator.

13. The improvement according to claim 6, wherein the piston includes a hollow sleeve portion and an actuating pin means extends transversely through said sleeve to actuate the mechanism which reloads the firearm.

14. The improvement of claim 13, wherein said piston sleeve has diametrically opposed, longitudinally extending slots formed therethrough and said pin extends through said slots.

15. The improvement of claim 14, wherein said pin means further comprises a pin member extending through said piston and resilient means fitted into said piston sleeve to ordinarily bias said pin member toward the rear end of said longitudinal slot and to absorb force on said pin when said piston is driven rearwardly.

16. In a gas-actuated autoloading firearm of the type wherein firing gases are tapped from the barrel into a gas chamber attached to a tubular magazine fixedly secured below the barrel, the improvement comprising:

a piston slidably disposed in the gas chamber to be driven rearward toward the breech of the firearm by the tapped gases and adapted to actuate mechanism to reload the firearm;

a cylindrical obturator slidably disposed in the gas chamber and arranged to be driven away from said piston by the tapped gases;

vent means for exhausting gases from said gas chamber opposite the obturator from the piston;

valve means cooperative between said piston and said obturator to vent the gases from the gas chamber when said piston and obturator move apart; and first and second biasing means to return both said piston and said obturator, respectively, to their original positions after the firing gases have been vented by said valve means through said vent means; wherein said piston and obturator, prior to firing, are contiguous, the contiguous faces of said piston and obturator are both concave, and the face of said piston has a slot formed therein adapted to initially receive firing gases.

17. In a gas-actuated autoloading firearm of the type wherein firing gases are tapped from the barrel into a gas chamber attached to a tubular magazine fixedly secured below the barrel, the improvement comprising:

a piston slidably disposed in the gas chamber to be driven rearward toward the breech of the firearm by the tapped gases and adapted to actuate mechanism to reload the firearm;

a cylindrical obturator slidably disposed in the gas chamber and arranged to be driven away from said piston by the tapped gases;

vent means for exhausting gases from said gas chamber opposite the obturator from the piston;

valve means cooperative between said piston and said obturator to vent the gases from the gas chamber when said piston and obturator move apart; and first and second biasing means to return both said piston and said obturator, respectively, to their original positions after the firing gases have been vented by said valve means through said vent means, further including a sleeve fitted above the exterior of the magazine, means cooperative with said piston to transmit motion of said piston to said sleeve, and grooves formed on the outer wall of said magazine with edges oriented to scrape the inside of said sleeve as it slides relative to said wall of said magazine.

* * * * *

UNITED STATES PATENT AND TRADEMARK OFFICE

CERTIFICATE OF CORRECTION

PATENT NO. : 3,982,468

DATED : September 28, 1976

INVENTOR(S) : Val A. Browning

It is certified that error appears in the above-identified patent and that said Letters Patent are hereby corrected as shown below:

Col. 1, line 42, change "unloading" to ---autoloading---.

Signed and Sealed this

Twenty-second Day of February 1977

[SEAL]

*Attest:*

RUTH C. MASON
*Attesting Officer*

C. MARSHALL DANN
*Commissioner of Patents and Trademarks*